US008086159B2

(12) United States Patent
Shinshi

(10) Patent No.: US 8,086,159 B2
(45) Date of Patent: Dec. 27, 2011

(54) FIXING DEVICE AND IMAGE FORMING APPARATUS INCLUDING THE FIXING DEVICE

(75) Inventor: Akira Shinshi, Machida (JP)

(73) Assignee: Ricoh Company Limited, Tokyo (JP)

( * ) Notice: Subject to any disclaimer, the term of this patent is extended or adjusted under 35 U.S.C. 154(b) by 344 days.

(21) Appl. No.: 11/945,639

(22) Filed: Nov. 27, 2007

(65) Prior Publication Data

US 2008/0175633 A1 Jul. 24, 2008

(30) Foreign Application Priority Data

Nov. 28, 2006 (JP) ..... 2006-319412
May 14, 2007 (JP) ..... 2007-127628

(51) Int. Cl.
*G03G 15/20* (2006.01)

(52) U.S. Cl. ..... 399/329

(58) Field of Classification Search ..... 399/329
See application file for complete search history.

(56) References Cited

U.S. PATENT DOCUMENTS

| | | | |
|---|---|---|---|
| 6,185,383 | B1 | 2/2001 | Kanari et al. |
| 6,864,461 | B2 | 3/2005 | Okabayashi et al. |
| 6,882,820 | B2 | 4/2005 | Shinshi et al. |
| 6,958,645 | B2 | 10/2005 | Okabayashi et al. |
| 2001/0022909 | A1 | 9/2001 | Takeuchi et al. |
| 2003/0002895 | A1 | 1/2003 | Kato et al. |
| 2004/0037579 | A1 | 2/2004 | Hashiguchi et al. |
| 2006/0002737 | A1 | 1/2006 | Shinshi |
| 2007/0003334 | A1 | 1/2007 | Shinshi et al. |
| 2007/0059003 | A1 | 3/2007 | Shinshi et al. |
| 2007/0059071 | A1 | 3/2007 | Shinshi et al. |
| 2007/0166085 | A1 | 7/2007 | Shinshi |
| 2007/0292175 | A1 | 12/2007 | Shinshi |
| 2008/0112739 | A1 | 5/2008 | Shinshi |
| 2008/0219730 | A1 | 9/2008 | Shinshi |

FOREIGN PATENT DOCUMENTS

| | | |
|---|---|---|
| JP | 6-43775 | 2/1994 |
| JP | 9-197864 | 7/1997 |
| JP | 9-197880 | 7/1997 |
| JP | 09-197880 | 7/1997 |
| JP | 2002-6656 | 1/2002 |
| JP | 2003-107948 | 4/2003 |

(Continued)

OTHER PUBLICATIONS

Chinese Office Action in corresponding Chinese Patent Application 2007101960022, dated Apr. 10, 2009.

*Primary Examiner* — David Gray
*Assistant Examiner* — Erika Villaluna
(74) *Attorney, Agent, or Firm* — Oblon, Spivak, McClelland, Maier & Neustadt, L.L.P.

(57) ABSTRACT

A fixing device and an image forming apparatus including the fixing device. The fixing device includes a heat source, an endless, flexible fixing member to fix a toner image by heating and melting the toner image onto a recording medium, a pressure member to press against the fixing member, a stationary facing member to face an inner surface of the fixing member and heat the fixing member while contacting the pressure member via the fixing member at a nip portion formed between the fixing member and the pressure member, and a reinforcement member to reinforce the facing member at the nip portion by contacting an inner surface of the facing member in a fixed manner.

40 Claims, 6 Drawing Sheets

FOREIGN PATENT DOCUMENTS

| | | | |
|---|---|---|---|
| JP | 2004-170692 | | 6/2004 |
| JP | 3592485 | | 9/2004 |
| JP | 2005-10607 | | 1/2005 |
| JP | 2006-251069 | | 9/2006 |
| JP | 2007026792 A | * | 2/2007 |
| JP | 2008-70582 | | 3/2008 |

* cited by examiner

FIXING DEVICE AND IMAGE FORMING APPARATUS INCLUDING THE FIXING DEVICE

CROSS-REFERENCE TO RELATED APPLICATIONS

This patent specification is based on and claims priority from Japanese Patent Application Nos. 2006-319412, filed on Nov. 28, 2006, and 2007-127628, filed on May 14, 2007 in the Japan Patent Office, the entire contents of each of which are incorporated by reference herein.

BACKGROUND

1. Field of the Invention

The present invention relates to a fixing device and an image forming apparatus including the fixing device.

2. Description of the Related Art

In an image forming apparatus such as a copier or a printer, a fixing belt stretched around a plurality of roller members is a known technique for configuring a fixing member.

A fixing device using such a fixing belt includes an endless fixing belt serving as a fixing member, a plurality of roller members that stretch and support the fixing belt, a heater that is provided in one of the plurality of roller members, and a pressure roller serving as a pressure member. The fixing belt is heated by the heater through the roller member. When a recording medium having a toner image thereon is pinched between the fixing belt and the pressure roller, the toner image is fixed onto the recording medium by the application of heat and pressure.

There is another type of fixing device that operates on demand with a short warm-up time.

Such an on-demand fixing device includes an endless fixing film serving as a fixing member, a pressure roller serving as a pressure member, and a heater such as a ceramic heater. The heater is disposed inside the fixing film and contacts the pressure roller via the fixing film to form a nip portion therebetween and heat the fixing film. When a recording medium having a toner image thereon is conveyed to the nip portion, the toner image is fixed onto the recording medium by the application of heat and pressure.

One technique to efficiently heat the fixing member is to produce a base layer of the fixing belt from radiant heat passing through material and a surface layer and an intermediate layer from radiant heat absorbing material. For example, a fixing device using this technique includes a fixing belt, a guide member that guides the fixing belt, a pressure roller, and a translucent pressure member that contacts the pressure roller via the fixing belt.

The fixing device using the fixing belt is suitable for high-speed operation compared to a fixing device using a fixing roller. However, there is a limit to reduction in a warm-up time, i.e., the time required for the temperature to rise to a level that enables printing, and a first print time, i.e., the time from receiving a print request to outputting printed paper.

By contrast, the on-demand fixing device has a small heat capacity, and therefore can reduce the warm-up time, the first print time, and the size of the fixing device. However, it is not the entire fixing film but only the nip portion thereof that is sufficiently heated. As a result, the fixing film is most cooled down at the entrance of the nip portion due to the rotation of the fixing film, which easily leads to poor fixing of the toner image onto the recording medium. This problem is not ignorable and is particularly acute with high-speed operation, since the amount of heat dissipated from the fixing film increases everywhere except at the nip portion as the rotation speed thereof increases.

One way to resolve this problem is to provide a pipe-shaped metal heat conductor facing the inner surface of the endless fixing member such as a fixing belt or a fixing film. The metal heat conductor is heated directly or indirectly so that the entire fixing member is sufficiently and uniformly heated.

However, in this case, the pipe-shaped metal heat conductor can be bent by the pressure applied from the pressure member at the nip portion. In particular, since the pipe-shaped metal heat conductor is made thin to improve the efficiency of heating the fixing member, the probability of occurrence of the bending problem increases.

When the metal heat conductor is bent it heavily abrades the inner surface of the fixing member, which produces wear in the inner surface of the fixing member and shortens the lifespan of the fixing member. In addition, a drive torque for driving the fixing member increases and causes the fixing member to slide, which can cause the paper to jam as it is pinched between the fixing member and the pressure member.

Furthermore, bending of the metal heat conductor increases variation in nip width at the nip portion. Specifically, the contact area of the fixing member with the pressure member decreases at the center portion in the long direction (hereinafter referred to as longitudinal) of the fixing member and the nip width at the center portion is smaller than the nip width at both longitudinal end portions. This variation causes a difference in the amount of heat applied to the recording medium between the center portion and both end portions. Consequently, a cold offset tends to occur at the center portion of an output image and a hot offset tends to occur at both end portions of the output image. Further, the difference in gloss between the center portion and the both end portions of the output image increases, resulting in output of an abnormal image with a large variation in gloss. In addition, when the variation in nip width is too large, the output image is affected and the recording medium may wrinkle.

The fixing device using the above-described technique using a fixing belt having the layers made of particular materials is intended to efficiently heat the fixing member, and not intended to resolve the above-described bending problem of the metal heat conductor. The guide member that guides the fixing belt is made of a translucent material and does not purposely heat the fixing belt. Although the translucent pressure member contacting the pressure roller via the fixing belt serves to form the nip portion between the fixing belt and the pressure roller, the translucent pressure member is a plate with a thickness of up to several millimeters, which can be bent by the pressure applied from the pressure roller.

SUMMARY

Described herein is a novel charging device that includes a heat source, an endless, flexible fixing member to fix a toner image by heating and melting the toner image onto a recording medium, a pressure member to press against the fixing member, a stationary facing member to face an inner surface of the fixing member and heat the fixing member while contacting the pressure member via the fixing member at a nip portion formed between the fixing member and the pressure member, and a reinforcement member to reinforce the facing member at the nip portion by contacting an inner surface of the facing member in a fixed manner.

Further described herein is a novel image forming apparatus that includes the fixing device.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
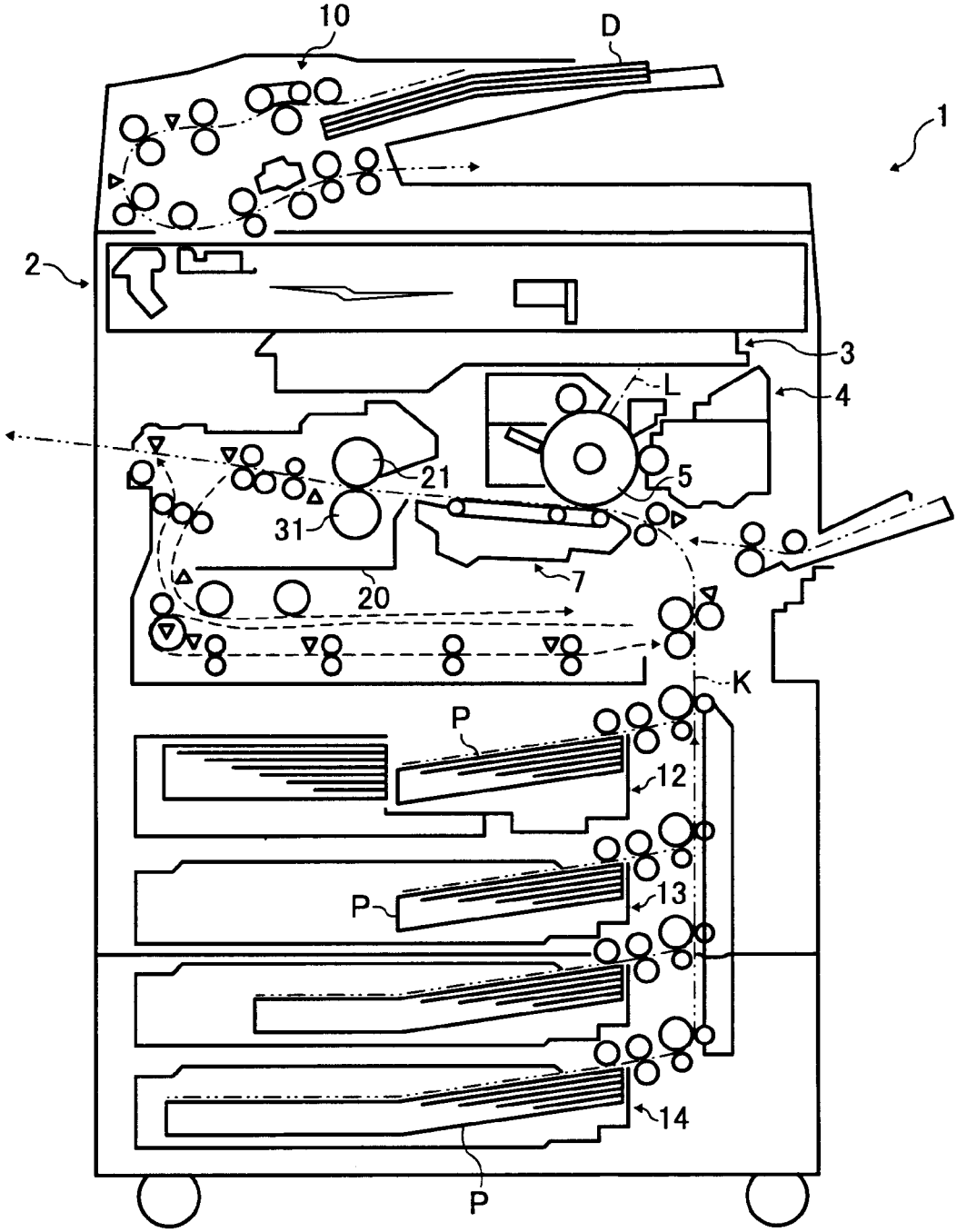
FIG. 1 is a diagram illustrating an overall configuration of an image forming apparatus according to a first embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Figure 2:
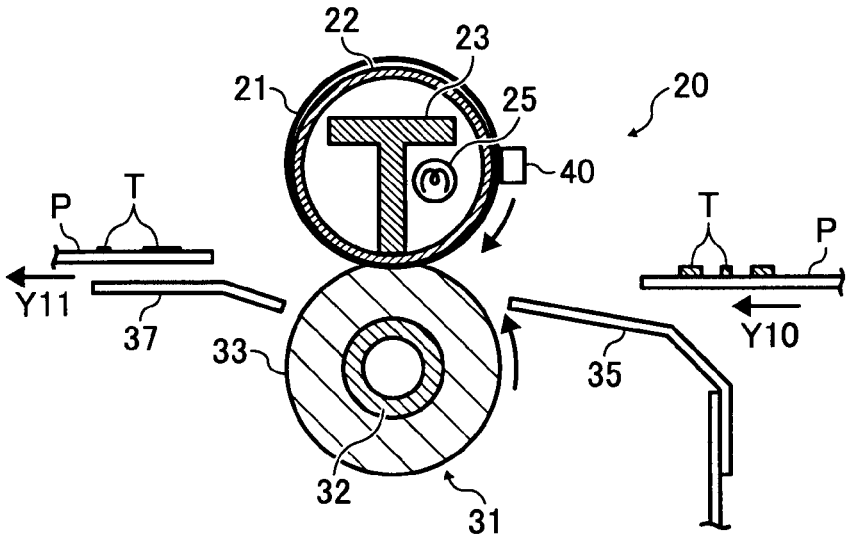
FIG. 2 is a diagram illustrating a configuration of a fixing device included in the image forming apparatus of FIG. 1.

Referring now to the drawings, wherein like reference numerals designate identical or corresponding parts throughout the several views thereof, particularly to FIG. 2, fixing devices according to exemplary embodiments of the present invention are described. The descriptions of identical or corresponding parts are hereinafter simplified or omitted as necessary.

Referring to FIGS. 1 through 4, a first embodiment of the present invention is described.

In order to facilitate an understanding and appreciation of the novel features and advantages of the present invention, the overall configuration and operation of an image forming apparatus according to the first embodiment are now described, again with reference to FIG. 1.

In FIG. 1, an image forming apparatus 1 includes an original read unit 2 that optically reads image information of an original D, an irradiation unit 3 that irradiates a photoconductive drum 5 with light L based on the image information read by the original read unit 2, an image forming unit 4 that forms a toner image T on the photoconductive drum 5, a transfer unit 7 that transfers the toner image T formed on the photoconductive drum 5 to a recording medium P, an original feed unit 10 that feeds the original D to the original read unit 2, paper feed units 12, 13, and 14 that store the recording medium P such as transfer paper, a fixing device 20 that fixes an unfixed image onto the recording medium P, a fixing belt 21 that serves as a fixing member provided in the fixing device 20, and a pressure roller 31 that serves as a pressure member provided in the fixing device 20.

A typical image formation by the image forming apparatus is described with reference to FIG. 1.

The original D placed on an original table is conveyed in the direction indicated by an arrow in FIG. 1 by conveyance rollers included in the original feed unit 10 and passes over the original read unit 2 where the image information of the original D is optically read.

The optical image information read by the original read unit 2 is converted into an electrical signal and transmitted to the irradiation unit 3 serving as a writing unit. Based on the image information of the electrical signal, the irradiation unit 3 emits the light L such as a laser beam to the photoconductive drum 5 in the image forming unit 4.

In the image forming unit 4, the photoconductive drum 5 rotates clockwise. Through image forming processes of charging, irradiating, and developing, a toner image T corresponding to the image information is formed on the photoconductive drum 5.

The transfer unit 7 transfers the toner image T formed on the photoconductive drum 5 to the recording medium P that has been conveyed by a registration roller.

The recording medium P is conveyed to the transfer unit 7 by the following operation:

One of the plurality of paper feed units 12, 13, and 14 in the image forming apparatus 1 is automatically or manually selected. By way of example, when the uppermost paper feed unit 12 is selected, the uppermost sheet stored in the paper feed unit 12 is conveyed to a conveyance path K.

The recording medium P passes through the conveyance path K and arrives at the registration roller that timely conveys the recording medium P to the transfer unit 7 so that the image formed on the photoconductive drum 5 is positioned on the recording medium P.

After the transferring process, the recording medium P passes through the transfer unit 7 and the conveyance path and arrives at the fixing device 20. In the fixing device 20, the recording medium P is pinched between the fixing belt 21 and the pressure roller 31. The image is fixed by application of heat from the fixing belt 21 and by application of pressure from the fixing belt 21 and the pressure roller 31. The recording medium P having the fixed image thereon is fed out from the nip portion and output from the image forming apparatus 1. The image formation is thus completed.

Figure 3:
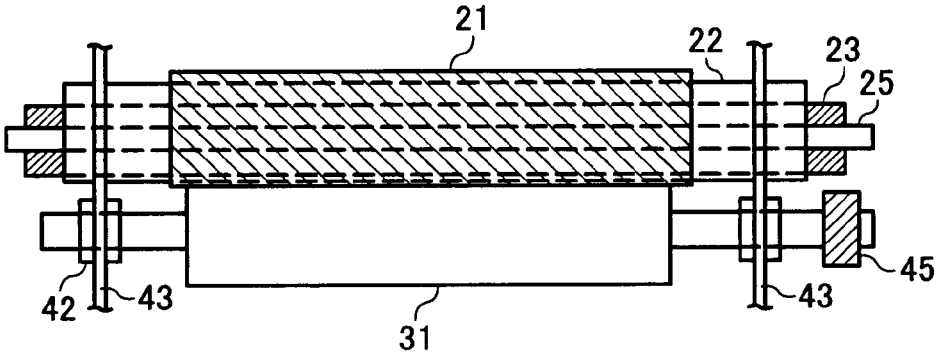
FIG. 3 is a diagram illustrating the fixing device of FIG. 2 as viewed from a latitudinal perspective.
Figure 4:
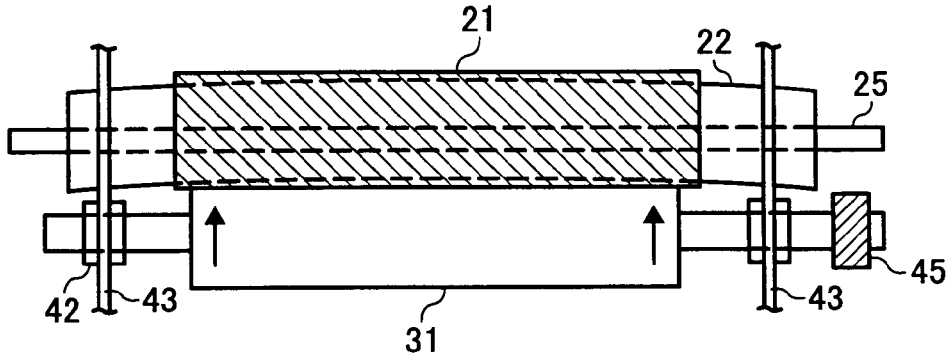
FIG. 4 is a diagram illustrating bending of a facing member.

Referring now to FIGS. 2 through 4, the configuration and operation of the fixing device 20 included in the image forming apparatus 1 are described.

FIG. 2 is a diagram illustrating the configuration of the fixing device 20. FIG. 3 is a diagram illustrating the fixing device 20 as viewed from a latitudinal perspective.

As illustrated in FIG. 2, the fixing device 20 includes the fixing belt 21 serving as a fixing member, a facing member 22, a reinforcement member 23, a heater 25 serving as a heat source, the pressure roller 31 serving as a pressure member, a temperature sensor 40, and guide plates 35 and 37.

The fixing belt 21 serving as a fixing member is a thin, flexible, endless belt that rotates clockwise. The fixing belt 21 is formed by laminating an elastic layer and a releasing layer on a substrate and has a thickness of 1 mm or less.

The substrate of the fixing belt 21 has a thickness of 30 to 50 μm and may be made of a metal such as nickel or stainless-steel or a resin material such as polyimide.

The elastic layer of the fixing belt 21 has a thickness of 100 to 300 μm and may be made of a rubber material such as silicone rubber, foamable silicone rubber, or fluororubber. By providing an elastic layer, small concavo-convex parts are not formed on the surface of the fixing belt 21 forming the nip portion and heat is uniformly transmitted to the toner image T on the recording medium P. Therefore, production of an image with an uneven surface is prevented.

The releasing layer of the fixing belt 21 has a thickness of 10 to 50 μm and may be made of a material such as PFA (polytetrafluoroethylene-perfluoroalkyl vinyl ether copolymer), polyimide, polyetherimide, or PES (polyether sulphone). By providing a releasing layer, proper release of the toner, or the toner image T, is ensured.

In general, the fixing belt 21 may have a diameter of 15 to 120 mm. The fixing belt 21 according to the first embodiment has a diameter of 30 mm.

Inside (in the inner surface side of) the fixing belt 21, the heater 25 (heat source), the facing member 22, and the reinforcement member 23 are provided in a fixed manner. The fixing belt 21 is pressed by the facing member 22 to form the nip portion between the fixing belt 21 and the pressure roller 31. The facing member 22 is reinforced by the reinforcement member 23.

The facing member 22 is provided in a fixed manner to face the inner surface of the fixing belt 21 and contacts the pressure roller 31 via the fixing belt 21 to form the nip portion therebetween. Referring to FIG. 3, both ends in the long direction (hereinafter referred to as longitudinal) of the facing member 22 are fixed to side plates 43 included in the fixing device 20.

The facing member 22 is formed such that the nip portion is formed into a substantially rectangular parallelepiped shape. Specifically, the surface of the facing member 22 that faces the pressure roller 31 at the nip portion is formed into a planar shape. Therefore, the nip portion is substantially parallel to the surface of the recording medium P on which the image is formed, which improves contact between the fixing belt 21 and the recording medium P and thus improves fixing ability. In addition, the curvature of the fixing belt 21 increases at the exit of the nip portion and therefore the recording medium P fed out from the nip portion is easily separated from the fixing belt 21.

It should be noted that although in cross section the facing member 22 is substantially circular, alternatively the facing member 22 may be formed to have a polygonal cross-sectional shape, or slits on the surface thereof.

In the first embodiment, the reinforcement member 23 that reinforces the facing member 22 at the nip portion is provided inside the fixing belt 21 in a fixed manner. Referring to FIG. 3, the reinforcement member 23 is formed such that the longitudinal length thereof is equal to that of the facing member 22. Both longitudinal ends of the reinforcement member 23 are fixed to the side plates 43 in the fixing device 20. Since the reinforcement member 23 contacts the pressure roller 31 via the facing member 22 and the fixing belt 21, the facing member 22 is prevented from being greatly deformed due to the pressure from the pressure roller 31 at the nip portion.

FIG. 4 is a diagram illustrating bending of the facing member 22 without the reinforcement member 23. The facing member 22 is bent by pressure from the pressure roller 31. As indicated by arrows in FIG. 4, the facing member 22 is greatly bent at the longitudinal center portion thereof by the pressure applied to the both longitudinal ends of the facing member 22. The bending problem is particularly acute in a case in which the facing member 22 is made thin to improve fixing belt 21 heating efficiency.

According to the first embodiment, the reinforcement member 23 is provided to limit deformation of the facing member 22. Therefore, when the facing member 22 is made thin, bending of the facing member 22 is reduced, thereby preventing the problems caused by bending of the facing member 22, such as abrasion of the inner surface of the fixing belt 21 or an increase in the drive torque for driving the fixing belt 21.

It is preferable to form the reinforcement member 23 from a metal material having high mechanical strength such as stainless-steel or iron to satisfy the above-described function. Further, by forming the reinforcement 23 with a long cross-sectional shape along the direction of the pressure from the pressure roller 31, the section modulus increases and the mechanical strength of the reinforcement member 23 is improved.

The heater 25 serving as a heat source is a halogen heater or a carbon heater and both ends of the heater 25 are fixed to the side plates 43 in the fixing device 20 as illustrated in FIG. 3. The facing member 22 is heated by radiant heat from the heater 25 and the output of the heater 25 is controlled by a power source of the image forming apparatus 1. The fixing belt 21 is entirely heated by the facing member 22 and the heated surface of the fixing belt 21 applies heat to the toner image T on the recording medium P. The output of the heater 25 is controlled based on belt surface temperature detection by the temperature sensor 40 such as a thermistor facing the surface of the fixing belt 21. Controlling the output of the heater 25 enables the temperature of the fixing belt 21, i.e., the fixing temperature, to be set to a desired temperature.

Referring to FIG. 2, the facing member 22 is provided in a fixed manner such that the facing member 22 faces the entire inner surface of the fixing belt 21 including the nip portion. The facing member 22 is heated by radiant heat from the heater 25 and heats the fixing belt 21, i.e., transmits the heat to the fixing belt 21. Materials available for the facing member 22 include a metal heat conductor, which is a metal having good heat conductivity, such as aluminum, iron, or stainless-steel.

In the fixing device 20 according to the first embodiment, the fixing belt 21 is not locally heated and substantially the entire fixing belt 21 is heated along the circumferential direction by the facing member 22. Therefore, high-speed operation can be performed without fixing failure because the fixing belt 21 is sufficiently heated. Since the fixing belt 21 is efficiently heated with a relatively simple configuration, the warm-up time and the first print time are shortened and the fixing device 20 is downsized.

A gap δ between the fixing belt 21 and the facing member 22 except at the nip portion is preferably more than 0 and not more than 1 mm, i.e., $0\ \text{mm} < \delta \leqq 1\ \text{mm}$. When the gap δ is too small, the fixing belt 21 is easily abraded. When the gap δ is too wide, the heating efficiency of the fixing belt 21 tends to deteriorate. In addition, by disposing the facing member 22 close to the fixing belt 21, the flexible fixing belt 21 substantially maintains its circular shape, and therefore degradation or damage caused by deformation of the fixing belt 21 is reduced.

The surface of the facing member 22 that makes abrasive contact with the fixing belt 21 can be made of a material having a low coefficient friction to reduce wear on the fixing belt 21 caused by such abrasive contact.

In the first embodiment, the reinforcement member 23 is formed from a metal heat conductor such as stainless-steel or iron and therefore accumulates heat from the heater 25 during printing. When printing is completed and the heater 25 is turned off, the facing member 22 is heated by the heat accumulated in the reinforcement member 23 and thus slowly cooled down. Therefore, the warm-up time to resume printing is shortened.

Referring to FIG. 2, the pressure roller 31 serving as a pressure member has a diameter of 30 mm and includes a hollow core 32 coated with an elastic layer 33. The elastic layer 33 may be made of a material such as foamable silicone rubber, silicone rubber, or fluororubber. On the surface layer of the elastic layer 33, a thin releasing layer of, for example, PFA or polytetrafluoroethylene (PTFE) can be provided. The pressure roller 31 is pressed against the fixing belt 21 to form a desirable nip portion therebetween. Referring to FIG. 3, the pressure roller 31 is provided with a gear 45 that engages a drive gear included in a drive mechanism, not shown, to be rotationally driven counterclockwise. The pressure roller 31 is rotatably supported at both longitudinal ends by the side plates 43 in the fixing device 20 via bearings 42. A heat source such as a halogen heater may be provided in the pressure roller 31.

The elastic layer 33 formed from a sponge material such as foamable silicone rubber reduces pressure applied to the nip portion, which further reduces bending of the facing member 22.

It should be noted that although the diameter of the fixing belt 21 is the same as that of the pressure roller 31 in the first embodiment, alternatively the diameter of the fixing belt 21 may be smaller than that of the pressure roller 31. An advantage accruing when the fixing belt 21 has a diameter smaller than that of the pressure roller 31 is that the curvature of the fixing belt 21 is smaller than that of the pressure roller 31 at the nip portion, and therefore the recording medium P fed out from the nip portion is easily separated from the fixing belt 21.

Referring to FIG. 2, on an entry side of the nip portion where the fixing belt 21 contacts the pressure roller 31, the guide plate 35 is disposed to guide the recording medium P conveyed to the nip portion. On an exit side of the nip portion, the guide plate 37 is disposed to guide the recording medium P fed out from the nip portion. The guide plates 35 and 37 are fixedly mounted on the side plates 43 in the fixing device 20.

A description is given below of the operation of the fixing device 20 having the above-described configuration.

By turning on a power switch of the image forming apparatus 1, power is supplied to the heater 25 and the pressure roller 31 is rotationally driven counterclockwise, thereby rotating the fixing belt 21 clockwise by frictional force exerted by the pressure roller 31.

The recording medium P is fed from the paper feed units 12, 13, and 14 and an unfixed image (toner image) T is transferred to the recording medium P at the image forming unit 4. The recording medium P carrying the unfixed image T is guided by the guide plate 35 and conveyed in the direction indicated by an arrow Y10 in FIG. 2 to the nip portion between the fixing belt 21 and the pressure roller 31, which are pressed against each other.

By application of heat from the fixing belt 21, which is heated by the facing member 22, i.e., the heater 25, and by application of pressure from the facing member 22, which is reinforced by the reinforcement member 23, and the pressure roller 31, the toner image T is fixed onto the surface of the recording medium P. Then, the recording medium P is fed out from the nip portion and conveyed in the direction indicated by an arrow Y11.

When the fixing device 20 according to the first embodiment includes the facing member 22 formed from aluminum having a wall thickness of 0.4 mm and reinforced by the reinforcement member 23 having a width of 2 mm, the variation in nip width between the longitudinal center portion and both longitudinal end portions is 1.5 mm. By comparison, to obtain the same variation in nip width without the reinforcement member 23, the aluminum facing member 22 would be required to have a wall thickness of 1.5 mm. That is, the wall of the facing member 22 can be thinned by using the reinforcement member 23 and the heat capacity thereof is decreased, which shortens the warm-up time of the fixing device 20.

As described above, the fixing device 20 according to the first embodiment includes the facing member 22 that faces the inner surface of the fixing belt 21 (fixing member) and heats the fixing belt 21 and the reinforcement member 23 that reinforces the facing member 22 at the nip portion by contacting the pressure roller 31 (pressure member) via the facing member 22 and the fixing belt 21. Therefore, the warm-up time and the first print time are shortened, longitudinal variation in nip width is reduced, and problems such as fixing failure do not occur during a high-speed operation.

It should be noted that although the present invention is applied to the fixing device using the pressure roller 31 as the pressure member in the first embodiment, the present invention is not limited thereto but is also applicable to a fixing device using a pressure belt or a pressure pad as the pressure member with the same effect as in the first embodiment.

Further, the fixing belt 21 having a plurality of layers is used as a fixing member in the first embodiment. Alternatively, however, an endless fixing film formed exclusively from a material such as polyimide, polyamide, fluororesin, or metal can be also used as a fixing member with the same effect as in the first embodiment.

A second embodiment of the present invention is now described with reference to FIG. 5.

Figure 5:
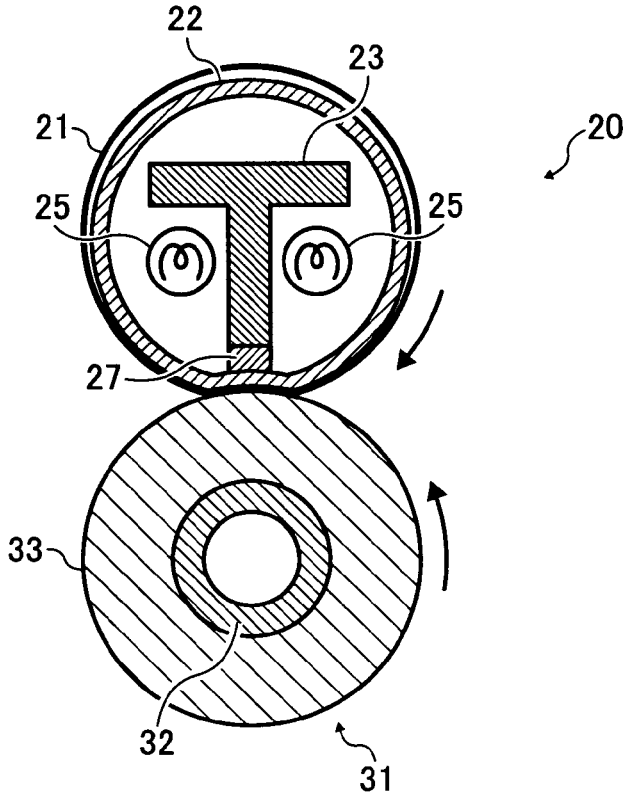
FIG. 5 is a diagram illustrating a configuration of a fixing device according to a second embodiment of the present invention.

FIG. 5 is a diagram illustrating the configuration of a fixing device according to the second embodiment of the present invention and corresponds to FIG. 2 illustrating the first embodiment of the present invention. The fixing device according to the second embodiment is the same as in the first embodiment, except that the facing member 22 is formed such that the nip portion is formed into an inwardly concave shape in the fixing member 21 and a heat insulating member 27 is provided between the reinforcement member 23 and the facing member 22.

Similar to the first embodiment, the fixing device 20 according to the second embodiment includes the fixing belt 21 (fixing member), the facing member 22, the reinforcement member 23, the heaters 25 (heat source), and the pressure roller 31 (pressure member) as illustrated in FIG. 5. In the second embodiment, however, two heaters 25 are provided inside the fixing belt 21 instead of the single heater 25 of the first embodiment.

In the second embodiment, the reinforcement member 23 contacts the pressure roller 31 via the heat insulating member 27, the facing member 22, and the fixing belt 21. Specifically, the heat insulating member 27 is provided between the reinforcement member 23 and the facing member 22. Materials available for the heat insulating member 27 include silicone rubber, heat-resistant resin, and heat-resistant felt.

The above-described configuration prevents heat transfer from the facing member 22 to the reinforcement member 23 at the nip portion, and thus the warm-up time of the fixing belt 21 is not extended. This is particularly effective in a case in which the reinforcement member 23 has a heat capacity larger than that of the facing member 22.

In the second embodiment, the surface of the reinforcement member 23 facing the heaters 25 is partially or entirely composed of a mirror.

Therefore, the heat from the heaters 25 that heat the reinforcement member 23 is used to heat the facing member 22, and therefore the efficiency of heating the fixing belt 21, or the facing member 22, is further improved. The rate of temperature rise of the reinforcement member 23 is thus slowed. However, the reinforcement member 23 still has the heat accumulation effect described above in the first embodiment.

In the second embodiment illustrated in FIG. 5, as noted above the facing member 22 assumes an inwardly concave shape at the nip portion, such that the surface of the facing member 22 facing the pressure roller 31 follows the curvature of the pressure roller 31. Therefore, the recording medium P is fed out from the nip portion following the curvature of the pressure roller 31, and thus the recording medium P is easily detached from the fixing belt 21 after fixing.

As described above, similar to the first embodiment, the fixing device 20 according to the second embodiment includes the facing member 22 that faces the inner surface of the fixing belt 21 and heats the fixing belt 21 and the reinforcement member 23 that reinforces the facing member 22 at the nip portion by contacting the pressure roller 31 (pressure member) via the facing member 22 and the fixing belt 21. Therefore, the warm-up time and the first print time are shortened, longitudinal variation in nip width is reduced, and problems such as fixing failure do not occur during a high-speed operation.

It should be noted that the facing member 22 having a concave shape is not limited to the second embodiment but the facing member in each embodiment described herein can have such an inwardly concave shape at the nip portion.

A third embodiment of the present invention is now described with reference to FIG. 6.

Figure 6:
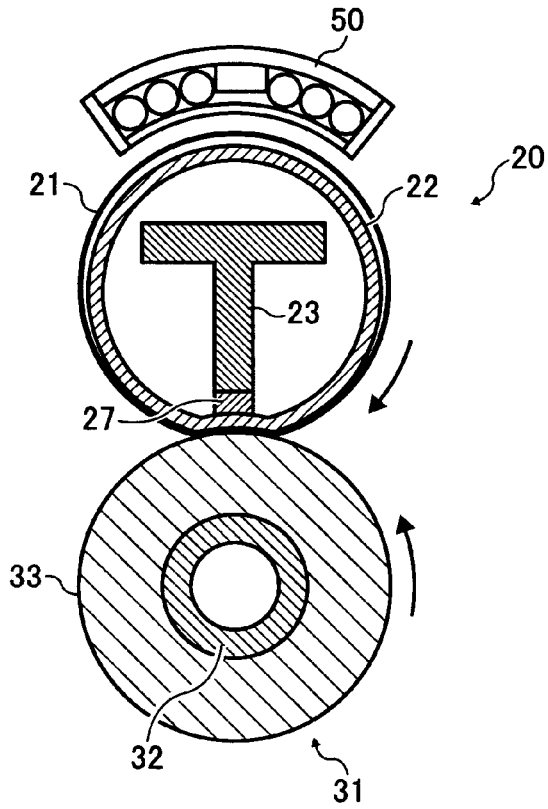
FIG. 6 is a diagram illustrating a configuration of a fixing device according to a third embodiment of the present invention.

FIG. 6 is a diagram illustrating the configuration of a fixing device according to the third embodiment of the present invention and corresponds to FIG. 5 illustrating the second embodiment of the present invention. The fixing device according to the third embodiment is the same as in the second embodiment, except that the facing member 22 is heated by electromagnetic induction.

Similar to the second embodiment, the fixing device 20 according to the third embodiment includes the fixing belt 21 (fixing member), the facing member 22, the reinforcement member 23, the pressure roller 31 (pressure member), and the heat insulating member 27 as illustrated in FIG. 6.

The fixing device 20 according to the third embodiment includes an electromagnetic heating unit 50 that heats the facing member 22 by electromagnetic induction, which is different from the fixing device according to the second embodiment in which the facing member 22 is heated by radiant heat from the heaters 25.

The electromagnetic heating unit 50 includes an excitation coil, a core, and a coil guide. The excitation coil includes a litz wire formed of thin wires extending in the longitudinal direction, i.e., the direction perpendicular to the page showing FIG. 6, by which the fixing belt 21 is partially covered. The coil guide may be made of, for example, a resin material with a high heat resistance and holds the excitation coil and the core. The core is a member having a half cylinder shape and may be made of a ferromagnet such as ferrite that has a relative magnetic permeability of from approximately 1000 to 3000. The core includes a central core and a side core to generate an effective magnetic flux toward the facing member 22. The core is disposed facing the excitation coil and extending in the longitudinal direction.

The operation of the fixing device 20 having the above-described configuration is described below.

When the fixing belt 21 is rotationally driven clockwise, the fixing belt 21 is heated at a position facing the electromagnetic heating unit 50. Specifically, an alternating current flows through the excitation coil at high frequencies and the magnetic field lines that alternate the direction thereof are generated around the facing member 22. At this point, an eddy current is generated on the surface of the facing member 22 and Joule heat is generated by electrical resistance at the facing member 22. With the Joule heat, the facing member 22 is heated by electromagnetic induction heating and the heated facing member 22 heats the fixing belt 21.

For effective electromagnetic induction heating of the facing member 22, it is preferable to provide the electromagnetic heating unit 50 such that the electromagnetic heating unit 50 faces the entire area of the facing member 22 in the circumferential direction thereof. Materials available for the facing member 22 include nickel, stainless-steel, iron, copper, cobalt, chromium, aluminum, gold, platinum, silver, tin, palladium, as well as alloys of any of these metals.

As described above, similar to the above-described embodiments, the fixing device 20 according to the third embodiment includes the facing member 22 that faces the inner surface of the fixing belt 21 and heats the fixing belt 21 and the reinforcement member 23 that reinforces the facing member 22 at the nip portion by contacting the pressure roller 31 via the facing member 22 and the fixing belt 21. Therefore, the warm-up time and the first print time are shortened, longitudinal variation in nip width is reduced, and problems such as fixing failure do not occur during a high-speed operation.

A fourth embodiment of the present invention is now described with reference to FIG. 7.

Figure 7:
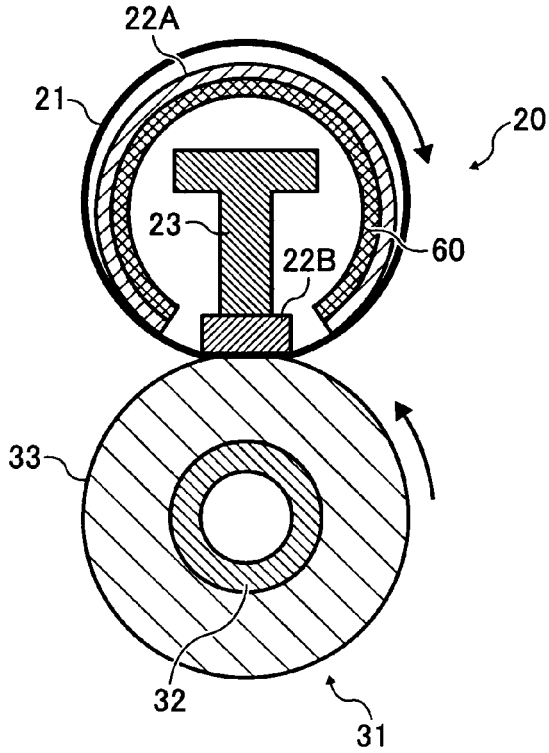
FIG. 7 is a diagram illustrating a configuration of a fixing device according to a fourth embodiment of the present invention.

FIG. 7 is a diagram illustrating the configuration of a fixing device according to the fourth embodiment of the present invention and corresponds to FIG. 5 illustrating the second embodiment of the present invention. The fixing device according to the fourth embodiment is the same as in the second embodiment, except that the facing member 22 is heated by a resistance heating element 60 and includes a first facing member 22B and a second facing member 22A.

Similar to the second embodiment, the fixing device 20 according to the fourth embodiment includes the fixing belt 21 (fixing member), the facing members 22A and 22B, and the pressure roller 31 (pressure member) as illustrated in FIG. 7.

The fixing device 20 according to the fourth embodiment includes the resistance heating element 60 inside the fixing belt 21. The facing member 22A (the second facing member) in the fourth embodiment is heated by the resistance heating element 60, which is different from the fixing device according to the second embodiment in which the facing member 22 is heated by radiant heat from the heaters 25.

The resistance heating element 60 is a planar heating element such as a ceramic heater, and is connected to a power source, not shown, at both ends thereof. When an electrical current flows through the resistance heating element 60, the temperature of the resistance heating element 60 rises by electrical resistance of the resistance heating element 60 and the second facing member 22A contacting the resistance heating element 60 is heated. The heated second facing member 22A then heats the fixing belt 21.

By using the resistance heating element 60 as a heat source to heat the facing member 22A, the fixing belt 21 is heated efficiently and relatively inexpensively.

The facing member according to the fourth embodiment also includes the first facing member 22B, which faces the inner surface of the fixing belt 21 at the nip portion, as well as the second facing member 22A, which faces the inner surface of the fixing belt 21 except at the nip portion.

The reinforcement member 23 is attached to the first facing member 22B so as to form a single integrated unit therewith and therefore directly forms the nip portion.

In the fourth embodiment, the first facing member 22B may be made of a heat insulating material to function as a heat insulating member. The second facing member 22A faces the fixing belt 21 except at the nip portion and purposely heats the fixing belt 21. That is, the nip portion serves as an opening of the second fixing member 22A in the fourth embodiment. Therefore, the heat capacity at the nip portion decreases and the efficiency of raising the temperature of the fixing belt 21 is improved.

As described above, similar to the above-described embodiments, the fixing device 20 according to the fourth embodiment includes the facing member 22A that faces the inner surface of the fixing belt 21 and heats the fixing belt 21 and the reinforcement member 23 that reinforces the facing member 22B at the nip portion by contacting the pressure roller 31 via the facing member 22B and the fixing belt 21. Therefore, the warm-up time and the first print time are shortened, longitudinal variation in nip width is reduced, and problems such as fixing failure do not occur during a high-speed operation.

In the fourth embodiment, the resistance heating element 60 is used as a heat source to heat the facing member 22. The facing member 22A can be also used as a resistance heating element, i.e., a heat source with the same effect as in the fourth embodiment.

A fifth embodiment of the present invention is now described with reference to FIG. 8.

Figure 8:
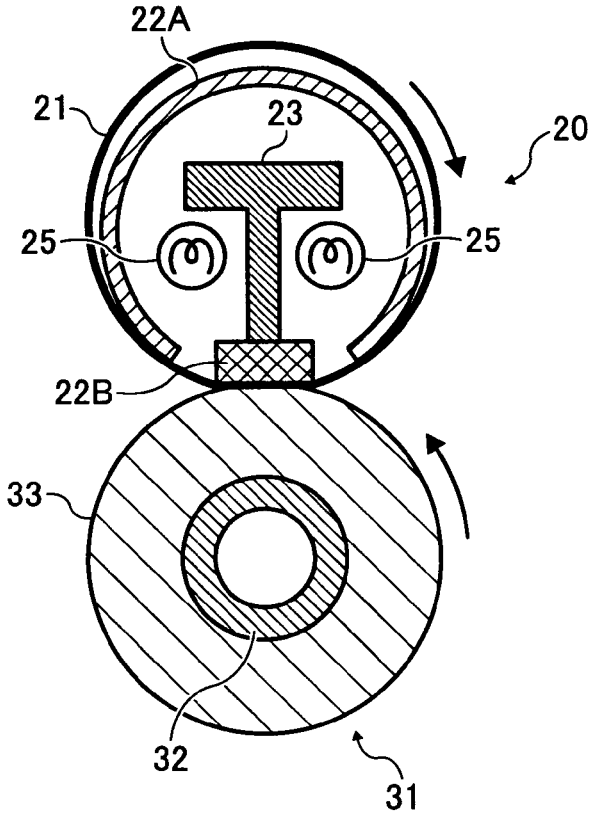
FIG. 8 is a diagram illustrating a configuration of a fixing device according to a fifth embodiment of the present invention.

FIG. 8 is a diagram illustrating the configuration of a fixing device according to the fifth embodiment of the present invention and corresponds to FIG. 5 illustrating the second embodiment of the present invention. The fixing device according to the fifth embodiment is the same as in the second embodiment, except that the facing member 22 includes a first facing member 22B formed from a translucent material and a second facing member 22A.

Similar to the second embodiment, the fixing device 20 according to the fifth embodiment includes the fixing belt 21 (fixing member), the facing members 22A and 22B, the reinforcement member 23, the heaters 25 (heat sources), and the pressure roller 31 (pressure member) as illustrated in FIG. 8. The fifth embodiment is the same as the fourth embodiment in that the facing member includes the first facing member 22B and the second facing member 22A.

In the fifth embodiment, the first facing member 22B may be made of a translucent material. Therefore, infrared radiation from the heaters 25 passes through the first facing member 22B and the fixing belt 21 is directly heated by radiant heat at the nip portion. Thus, the heat supply increases at the nip portion and fixing ability is improved.

As described above, similar to the above-described embodiments, the fixing device 20 according to the fifth embodiment includes the facing member 22A that faces the inner surface of the fixing belt 21 and heats the fixing belt 21 and the reinforcement member 23 that reinforces the facing member 22B at the nip portion by contacting the pressure roller 31 via the facing member 22B and the fixing belt 21. Therefore, the warm-up time and the first print time are shortened, longitudinal variation in nip width is reduced, and problems such as fixing failure do not occur during a high-speed operation.

A sixth embodiment of the present invention is now described with reference to FIG. 9.

Figure 9:
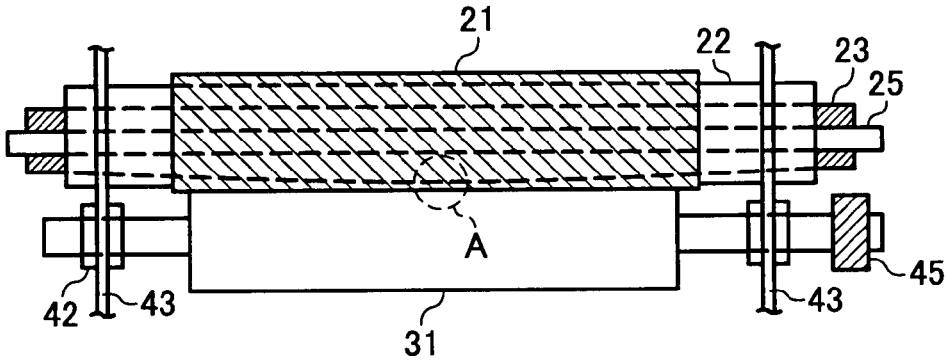
FIG. 9 is a diagram illustrating a fixing device according to a sixth embodiment of the present invention as viewed from a latitudinal perspective.

FIG. 9 is a diagram illustrating a fixing device according to the sixth embodiment of the present invention as viewed from a latitudinal perspective and corresponds to FIG. 3 illustrating the first embodiment of the present invention. The fixing device according to the sixth embodiment is the same as in the first embodiment, except that the reinforcement member 23 is formed into a convex shape when viewed from the latitudinal perspective.

As illustrated in FIG. 9, in the sixth embodiment, the reinforcement member 23 is arched, i.e., an outwardly convex center portion A bulges toward the pressure roller 31 relative to both end portions in the longitudinal direction.

When the longitudinal center portion of the facing member 22 is greatly bent compared with the both longitudinal end portions due to the configuration of a pressure mechanism, the reinforcement member 23 formed into a convex shape compensates for the difference in the bending amount. Therefore, longitudinal variation in bending of the facing member 22 is reduced, longitudinal variation in nip width is reduced, and uniform, good fixing ability is achieved over the entire longitudinal area.

When the fixing device 20 according to the sixth embodiment includes the facing member 22 formed from aluminum having a wall thickness of 0.4 mm and reinforced by the reinforcement member 23 having a width of 2 mm and an outwardly convex center portion with a 0.4 mm bulge relative to the both end portions in the longitudinal direction, the variation in nip width is approximately 0 mm. By comparison, when the fixing device 20 according to the first embodiment uses the reinforcement member 23 having no such outwardly convex bulge, the variation in nip width is 1.5 mm. Therefore, by forming the reinforcement member 23 into an outwardly convex bulge, longitudinal variation in nip width is reduced.

As described above, similar to the above-described embodiments, the fixing device 20 according to the sixth embodiment includes the facing member 22 that faces the inner surface of the fixing belt 21 and heats the fixing belt 21 and the reinforcement member 23 that reinforces the facing member 22 at the nip portion by contacting the pressure roller 31 via the facing member 22 and the fixing belt 21. Therefore, the warm-up time and the first print time are shortened, longitudinal variation in nip width is reduced, and problems such as fixing failure do not occur during a high-speed operation.

A seventh embodiment of the present invention is now described with reference to FIG. 10.

Figure 10:
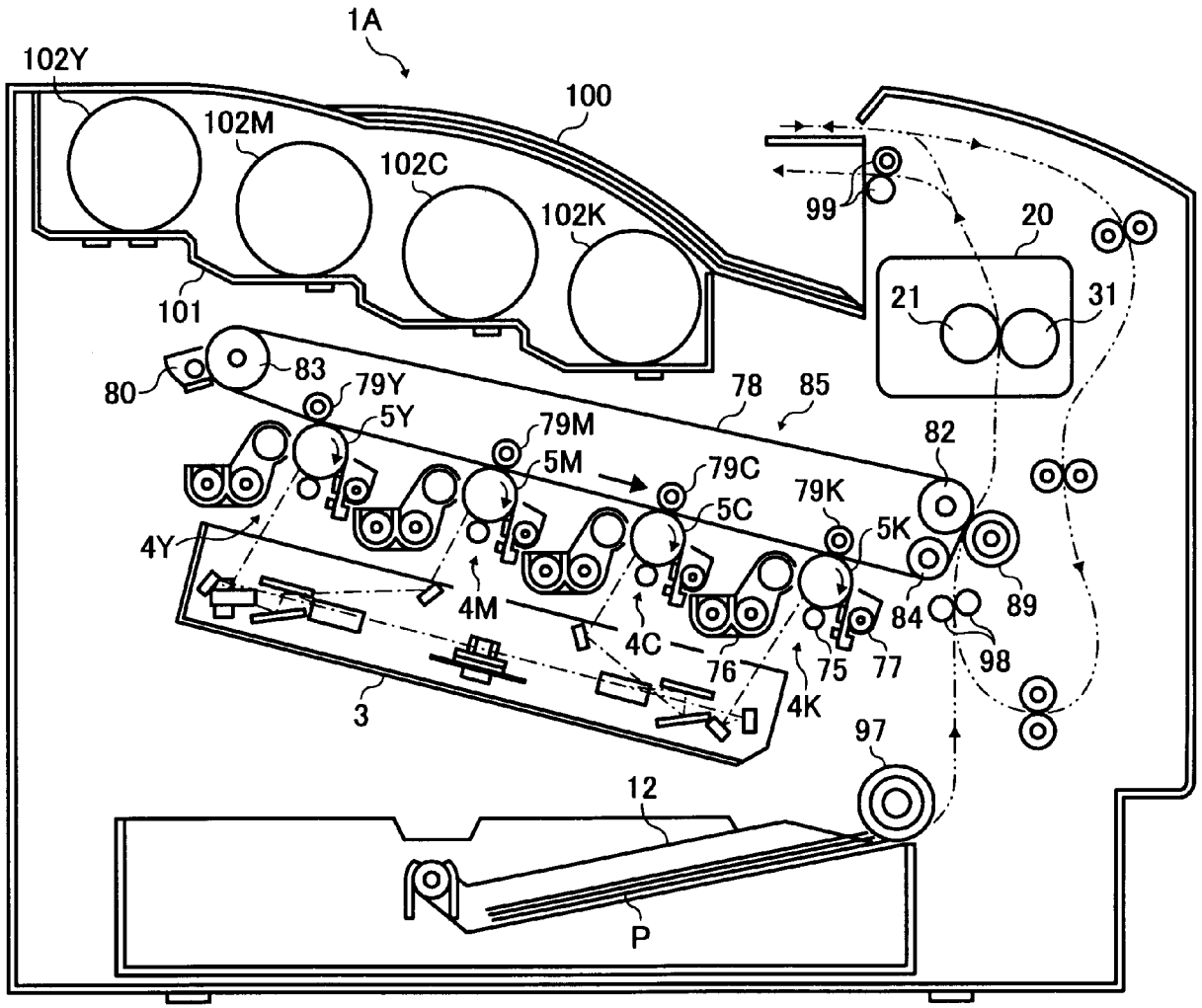
FIG. 10 is a diagram illustrating an overall configuration of an image forming apparatus according to a seventh embodiment of the present invention.

FIG. 10 is a diagram illustrating an overall configuration of an image forming apparatus according to the seventh embodiment of the present invention. The seventh embodiment is different from the first embodiment in that the fixing device is provided in a color image forming apparatus instead of a monochrome image forming apparatus.

As illustrated in FIG. 10, an image forming apparatus 1A according to the seventh embodiment is a tandem color printer. In a bottle container 101 provided in the upper portion of the image forming apparatus 1A, four replaceable toner bottles 102Y, 102M, 102C, and 102K corresponding to the four colors yellow, magenta, cyan, and black, respectively, are detachably installed.

Below the bottle container 101, an intermediate transfer unit 85 is provided. Image forming units 4Y, 4M, 4C, and 4K corresponding to the four colors yellow, magenta, cyan, and black, respectively, are arranged side by side facing an intermediate transfer belt 78 included in the intermediate transfer unit 85.

The image forming units 4Y, 4M, 4C, and 4K include photoconductive drums 5Y, 5M, 5C, and 5K, respectively. A charging unit 75, a development unit 76, a cleaning unit 77, and a discharging unit, not shown, are provided around each of the photoconductive drums 5Y, 5M, 5C, and 5K. On each of the photoconductive drums 5Y, 5M, 5C, and 5K, the image forming processes of charging, irradiating, developing, transferring and cleaning are performed to form an image of each color.

The photoconductive drums 5Y, 5M, 5C, and 5K are rotationally driven clockwise by a drive motor, not shown. At the charging unit 75, the surface of each of the photoconductive drums 5Y, 5M, 5C, and 5K is uniformly charged (the charging process).

When arriving at a position for irradiation with a laser beam emitted from the irradiation unit 3, each of the charged surfaces of the photoconductive drums 5Y, 5M, 5C, and 5K is irradiated to form a latent electrostatic image corresponding to each color (the irradiating process).

When arriving at a position facing the development unit 76, the latent electrostatic images on the surfaces of the photoconductive drums 5Y, 5M, 5C, and 5K are developed to form toner images of the four colors (the developing process).

When arriving at a position facing the intermediate transfer belt 78 and primary transfer bias rollers 79Y, 79M, 79C, and 79K, the toner images on the photoconductive drums 5Y, 5M, 5C, and 5K are transferred to the intermediate transfer belt 78, which is referred to as a primary transfer process. After the primary transfer process, a small amount of untransferred toner remains on the photoconductive drums 5Y, 5M, 5C, and 5K.

At a position facing the cleaning unit 77, the untransferred toner remaining on each of the photoconductive drums 5Y, 5M, 5C, and 5K is mechanically collected by a cleaning blade included in the cleaning unit 77 (the cleaning process).

At a position facing the discharging unit, not shown, residual potential is removed from the photoconductive drums 5Y, 5M, 5C, and 5K. The image formation on the photoconductive drums 5Y, 5M, 5C and 5K is thus completed.

The toner images of the four colors formed on the photoconductive drums 5Y, 5M, 5C, and 5K through the developing process are superimposed and transferred to the intermediate transfer belt 78 one atop another to form a full color image thereon.

The intermediate transfer unit 85 includes the intermediate transfer belt 78, the four primary transfer bias rollers 79Y, 79M, 79C, and 79K, a secondary transfer back-up roller 82, a cleaning back-up roller 83, a tension roller 84, and an intermediate transfer cleaning unit 80. The intermediate transfer belt 78 is stretched and supported by the three rollers 82, 83 and 84 and rotationally driven by the roller 82 to endlessly move in the direction of the arrow shown in FIG. 10.

Each of the primary transfer bias rollers 79Y, 79M, 79C, and 79K and each of the photoconductive drums 5Y, 5M, 5C, and 5K form a primary transfer nip with the intermediate transfer belt 78 therebetween. A bias with a reverse polarity to that of the toner is applied to the primary transfer bias rollers 79Y, 79M, 79C, and 79K.

The intermediate transfer belt 78 travels in the direction of the arrow and passes through the primary transfer nips formed by the primary transfer bias rollers 79Y, 79M, 79C, and 79K, thereby transferring the toner images on the photoconductive drums 5Y, 5M, 5C, and 5K to the intermediate transfer belt 78 one atop another.

The intermediate transfer belt 78 having the superimposed toner images transferred thereto arrives at a position facing a secondary transfer roller 89 where the secondary transfer back-up roller 82 and the secondary transfer roller 89 form a secondary transfer nip with the intermediate transfer belt 78 therebetween. The toner images of four colors formed on the intermediate transfer belt 78 is transferred to a recording medium P conveyed to the secondary transfer nip. After the transfer, toner that is not transferred to the recording medium P remains on the intermediate transfer belt 78.

At the intermediate transfer cleaning unit 80, the toner remaining on the intermediate transfer belt 78 is collected.

The transfer process on the intermediate transfer belt 78 is thus completed.

The recording medium P conveyed to the secondary transfer nip is conveyed from a paper feed unit 12 provided in the lower portion of the image forming apparatus 1A by a paper feed roller 97 and registration rollers 98.

Specifically, a plurality of recording media P such as transfer paper are stacked in the paper feed unit 12. When the paper feed roller 97 is rotationally driven counterclockwise, the uppermost recording medium P is conveyed to the registration rollers 98.

The registration rollers 98 suspend rotation and the recording medium P stops at the roller nip between the registration rollers 98. The registration rollers 98 are rotationally driven in accordance with the conveyance of the color image on the intermediate transfer belt 78 and the recording medium P is conveyed to the secondary transfer nip. Thus, the desirable color image is transferred to the recording medium P.

The recording medium P to which the color image has been transferred at the secondary transfer nip is conveyed to a fixing device 20. At the fixing device 20, the color image transferred to the surface of the recording medium P is fixed thereto by application of heat and pressure from a fixing belt 21 and a pressure roller 31.

The fixing device 20 according to the seventh embodiment is configured and operates in the same way as in the first embodiment. Specifically, the seventh embodiment is the same as the first embodiment in that the fixing device 20 includes the facing member 22 that faces the inner surface of the fixing belt 21 and heats the fixing belt 21 and the reinforcement member 23 that reinforces the facing member 22 at the nip portion by contacting the pressure roller 31 via the facing member 22 and the fixing belt 21.

The recording medium P is output from the image forming apparatus 1A through paper output rollers 99 and sequentially stacked on a stack portion 100 as an output image.

The image formation in the image forming apparatus 1A is thus completed.

As described above, similar to the above-described embodiments, the fixing device 20 according to the seventh embodiment includes the facing member 22 that faces the inner surface of the fixing belt 21 and heats the fixing belt 21 and the reinforcement member 23 that reinforces the facing member 22 at the nip portion by contacting the pressure roller 31 via the facing member 22 and the fixing belt 21. Therefore, the warm-up time and the first print time are shortened, longitudinal variation in nip width is reduced, and problems such as fixing failure do not occur during a high-speed operation.

It should be noted that the present invention is not limited to each of the above-described embodiments, and therefore the number, position, and shape of the above-described components are not limited to those described in each of the embodiments and can be changed in a way to adequately achieve the present invention.

As can be understood by those skilled in the art, numerous additional modifications and variations are possible in light of the above teachings. It is therefore to be understood that, within the scope of the appended claims, the disclosure of this patent specification may be practiced otherwise than as specifically described herein.

Further, elements and/or features of different example embodiments may be combined with each other and/or substituted for each other within the scope of this disclosure and appended claims.

Still further, any one of the above-described and other example features of the present invention may be embodied in the form of an apparatus, method, system, computer program or computer program product. For example, the aforementioned methods may be embodied in the form of a system or device, including, but not limited to, any of the structures for performing the methodology illustrated in the drawings.

Example embodiments being thus described, it will be apparent that the same may be varied in many ways. Such variations are not to be regarded as a departure from the spirit and scope of the present invention, and all such modifications as would be obvious to one skilled in the art are intended to be included within the scope of the following claims.

What is claimed is:

1. A fixing device comprising:

a heat source;

an endless, flexible fixing member which fixes a toner image by heating and melting the toner image onto a recording medium;

a pressure member which presses against the fixing member;

a metal heat conducting member heated by the heat source, which heats the fixing member while facing an entire inner circumferential area thereof including a nip portion formed between the fixing member and the pressure member, and abrading a portion of the inner circumferential area; and a reinforcement member which reinforces the metal heat conducting member at the nip portion by contacting an inner surface of the metal heat conducting member.

2. The fixing device according to claim 1, wherein the reinforcement member comprises a metal heat conductor.

3. The fixing device according to claim 1, further comprising a heat insulating member provided between the reinforcement member and the metal heat conducting member.

4. The fixing device according to claim 1, wherein the reinforcement member has a center portion formed outwardly convex toward the pressure member relative to end portions in a long direction thereof.

5. The fixing device according to claim 1, wherein the metal heat conducting member is heated by radiant heat from the heat source.

6. The fixing device according to claim 5, wherein at least part of a surface of the reinforcement member facing the heat source is a mirror.

7. The fixing device according to claim 1, wherein the heat source is an electromagnetic heating unit, located outside the fixing member, and wherein the metal heat conducting member is located facing the electromagnetic heating unit and produces heat with a magnetic flux from the metal heat conducting member.

8. The fixing device according to claim 1, wherein the heat source is a resistance heating element and the metal heat conducting member is heated by the resistance heating element.

9. The fixing device according to claim 1, wherein the metal heat conducting member comprises a resistance heating element.

10. The fixing device according to claim 1, wherein the metal heat conducting member comprises:

a first metal heat conducting member facing an inner surface of the fixing member at the nip portion; and a second metal heat conducting member facing the inner surface of the fixing member except at the nip portion, the reinforcement member attached to the first facing member so as to form a single integrated unit therewith.

11. The fixing device according to claim 10, wherein the heat source is provided inside the fixing member and configured to emit radiant heat, and the first metal heat conducting member is formed from a translucent material.

12. The fixing device according to claim 1, wherein the pressure member comprises a sponge-like elastic layer.

13. The fixing device according to claim 1, wherein the fixing member comprises a fixing belt or a fixing film.

14. An image forming apparatus comprising the fixing device of claim 1.

15. The fixing device according to claim 1, wherein the reinforcement member includes a portion which extends along a direction of pressure from the pressure member.

16. A fixing device comprising:

a heat source;

an endless, flexible fixing member which fixes a toner image by heating and melting the toner image onto a recording medium;

a pressure member configured to be in contact with the fixing member, and form a nip portion with the fixing member;

a heat insulating member, located in the fixing member, configured to contact the pressure member with pressure at the nip portion through the fixing member;

a metal heat conducting member heated by the heat source, which heats the fixing member while facing at least a portion of an inner circumferential area, and abrading the portion of the inner circumferential area; and a reinforcement member which reinforces the heat insulating member at the nip portion by contacting an inner surface of the heat insulating member.

17. The fixing device according to claim 16, wherein the reinforcement member comprises a metal heat conductor.

18. The fixing device according to claim 16, wherein the reinforcement member has a center portion formed outwardly convex toward the pressure member relative to end portions in a long direction thereof.

19. The fixing device according to claim 16, wherein the metal heat conducting member is heated by radiant heat from the heat source.

20. The fixing device according to claim 19, wherein at least part of a surface of the reinforcement member facing the heat source is a mirror.

21. The fixing device according to claim 16, wherein the heat source is an electromagnetic heating unit, located outside the fixing member, and wherein the metal heat conducting member is located facing the electromagnetic heating unit and produces heat with a magnetic flux from the electromagnetic heating unit.

22. The fixing device according to claim 16, wherein the heat source is a resistance heating element and the metal heat conducting member is heated by the resistance heating element.

23. The fixing device according to claim 16, wherein the metal heat conducting member comprises a resistance heating element.

24. The fixing device according to claim 16, wherein the metal heat conducting member is formed of an alloy including plural metals.

25. The fixing device according to claim 16, wherein the fixing device comprises side plates configured to support the fixing member at both ends thereof in a longitudinal direction.

26. The fixing device according to claim 16, wherein the fixing device comprises side plates configured to support the fixing member at both ends thereof in a longitudinal direction and configured to support the metal heat conducting member.

27. An image forming apparatus comprising the fixing device of claim 16.

28. A fixing device comprising:

a heat source;

an endless, flexible fixing member which fixes a toner image by heating and melting the toner image onto a recording medium;

a pressure member configured to be in contact with the fixing member, and form a nip portion with the fixing member;

a heat insulating member, located in the fixing member, configured to contact the pressure member with pressure at the nip portion through the fixing member;

a metal heat conducting member heated by the heat source, which heats the fixing member while facing at least a portion of an inner circumferential area, and abrading the portion of the inner circumferential area; and a reinforcement member which reinforces the heat insulating member at the nip portion by contacting a surface of the heat insulating member.

29. The fixing device according to claim 28, wherein the heat source is an electromagnetic heating unit, located outside the fixing member, wherein the metal heat conducting member is located facing the electromagnetic heating unit and produces heat with a magnetic flux from the electromagnetic heating unit.

30. The fixing device according to claim 28, wherein the metal heat conducting member is formed of an alloy including plural metals.

31. The fixing device according to claim 28, wherein the fixing device comprises side plates configured to support the fixing member at both ends thereof in a longitudinal direction.

32. The fixing device according to claim 28, wherein the fixing device comprises side plates configured to support the fixing member at both ends thereof in a longitudinal direction and configured to support the metal heat conducting member.

33. An image forming apparatus comprising the fixing device of claim 28.

34. An image forming apparatus including a fixing device, the fixing device comprising:

an endless fixing belt which fixes a toner image by heating and melting the toner image onto a recording medium;

a pressure roller configured to be in contact with the fixing belt, and form a nip portion with the fixing belt;

a heat insulating member, located in the fixing belt, configured to contact the pressure roller with pressure at the nip portion via the fixing belt;

an electromagnetic heating unit located outside the fixing belt;

a metal heat conducting member heated by the electromagnetic heating unit, which heats the fixing belt while facing at least a portion of an inner circumferential area, and abrading the portion of the inner circumferential area; and a reinforcement member, which is a metal member located inside the fixing belt and which reinforces the heat insulating member at the nip portion by contacting a surface of the heat insulating member.

35. The image forming apparatus according to claim 34, wherein the metal heat conducting member is formed of an alloy including plural metals.

36. The image forming apparatus according to claim 34, wherein the fixing device comprises side plates configured to support the fixing belt at both ends thereof in a longitudinal direction.

37. The image forming apparatus according to claim 34, wherein the fixing device comprises side plates configured to support the fixing belt at both ends thereof in a longitudinal direction and configured to support the metal heat conducting member.

38. The image forming apparatus according to claim 34, wherein the fixing device comprises side plates configured to support the reinforcement member at both ends thereof in a longitudinal direction.

39. The image forming apparatus according to claim 34, wherein the reinforcement member extends in a longitudinal direction.

40. The image forming apparatus according to claim 34, wherein the reinforcement member includes a first long cross-sectional part extending in a direction along a pressure from the pressure roller and a second long cross-sectional part extending in a direction perpendicular to the direction along the pressure from the pressure roller.

* * * * *